United States Patent [19]

Arnaison et al.

[11] 4,284,224

[45] Aug. 18, 1981

[54] RIVETING DEVICE USING A SHAPED CHARGE

[75] Inventors: Jean-Claude Arnaison; Jean-Claude Lacote, both of Bourges, France

[73] Assignee: L'Etat Francais represente par le Delegue General pour l'Armement, Paris, France

[21] Appl. No.: 62,298

[22] Filed: Jul. 31, 1979

[30] Foreign Application Priority Data

Jul. 5, 1978 [FR] France ..... 78 19952

[51] Int. Cl.[3] ..... B21J 15/18

[52] U.S. Cl. ..... 227/9

[58] Field of Search ..... 89/1 B; 102/24 HC, 56 SC; 227/9, 11; 60/632-638

[56] References Cited

U.S. PATENT DOCUMENTS

| | | | |
|---|---|---|---|
| 2,455,825 | 12/1948 | Temple | 89/1 B |
| 3,046,890 | 7/1962 | Dardick | 227/9 |
| 3,354,658 | 11/1967 | Leonardi | 227/9 |
| 3,597,919 | 8/1971 | Lilly | 60/634 |
| 3,902,238 | 9/1975 | Monson | 227/9 |

FOREIGN PATENT DOCUMENTS

| | | | |
|---|---|---|---|
| 316871 | 6/1930 | United Kingdom | 227/9 |

*Primary Examiner*—John McQuade

*Attorney, Agent, or Firm*—Stevens, Davis, Miller & Mosher

[57] ABSTRACT

A rivet apparatus is provided for securing together a first element to a second element made of solid metal. The apparatus comprises a support 3 which is common to the first element and to a hollow charge 4. A metal rivet or nail 5 embedded in the charge of the hollow charge, in the axis of a liner 6 of the hollow charge 4. The support 3 has a surface 7 intended to be applied against a second hard metal element 2 and approximately centered on the focal point F of the hollow charge 4. Upon detonation of the charge, the metal rivet or nail 5 enters the second element 2 thereby binding first and second elements together.

5 Claims, 6 Drawing Figures

RIVETING DEVICE USING A SHAPED CHARGE

The present invention relates to a riveting device which is intended for fixing a first element to a second element made of hard metal.

The device in accordance with the invention is intended for both civilian applications (erection of metallic frames, naval construction, etc.) and for military applications (assembling of chasses of tanks, attaching a parasitic element such as a mine to the bottom of an armored vehicle upon the passage of the latter, etc.). The attaching operation must be rapid and effective and its effect must be lasting. The rapidity of this operation is related to economic necessities in civilian applications of the device and in certain of its military applications (manufacture, for instance, of tanks); it is made indispensable by the movement of the target when it is a question of fastening a parasitic element to the underbody of an armored vehicle.

If one studies this last-mentioned case in further detail, it is necessary, in order for the attachment of the parasitic element to the target to be effective:

that it be effected within a short time (a few milliseconds);

that it be strong: It must hold a parasitic element of a weight equal to a few kilograms;

that it be lasting: It must retain its properties until the time of operation of the parasitic element and do so under severe conditions of impact or vibration.

The object of the present invention is to provide a riveting device which not only has the characteristics set forth above (rapidity, effectiveness, permanence), but also is simple, reliable and economically feasible.

In accordance with the invention, this goal is achieved essentially by virtue of the fact that the device comprises a support which is common to the element to be attached and to a hollow charge and a metal rivet or nail which is embedded in the charge of the hollow charge, within the axis of the liner thereof, the support having a surface which is intended to be applied against the element of hard metal and is approximately centered on the focus of the hollow charge.

One thus obtains an effective pyrotechnical nailing or riveting device which employs both the effect of the hollow charge to produce a hole in the hard-metal element and the effect of the propulsion of projectiles by explosion to embed the nail immediately thereafter in the hole which has just been formed. The combination of these two effects provides an essential contribution to the originality of the device and introduces a definite improvement over the known riveting devices.

The liner of the hollow charge is preferably made of a material which is capable of assuring the brazing of the nail within the hole formed in the hard metal element by the hollow charge. The attachment is thus made stronger.

In accordance with a preferred embodiment, the nail is directly made a part of the liner of the hollow charge by being, for instance, made integral with said liner. This facilitates the mounting of the nail in the axis of the liner upon the manufacture of the device and therefore in the axis of the hole which will be formed in the hard-metal element by the hollow charge.

The invention will now be explained in further detail with reference to the accompanying drawings.

FIG. 1 of the drawings shows in elevation, with portions in section, a riveting device in accordance with the invention and furthermore, diagrammatically, the element to be attached and the receiving element of hard metal.

Figure 1:
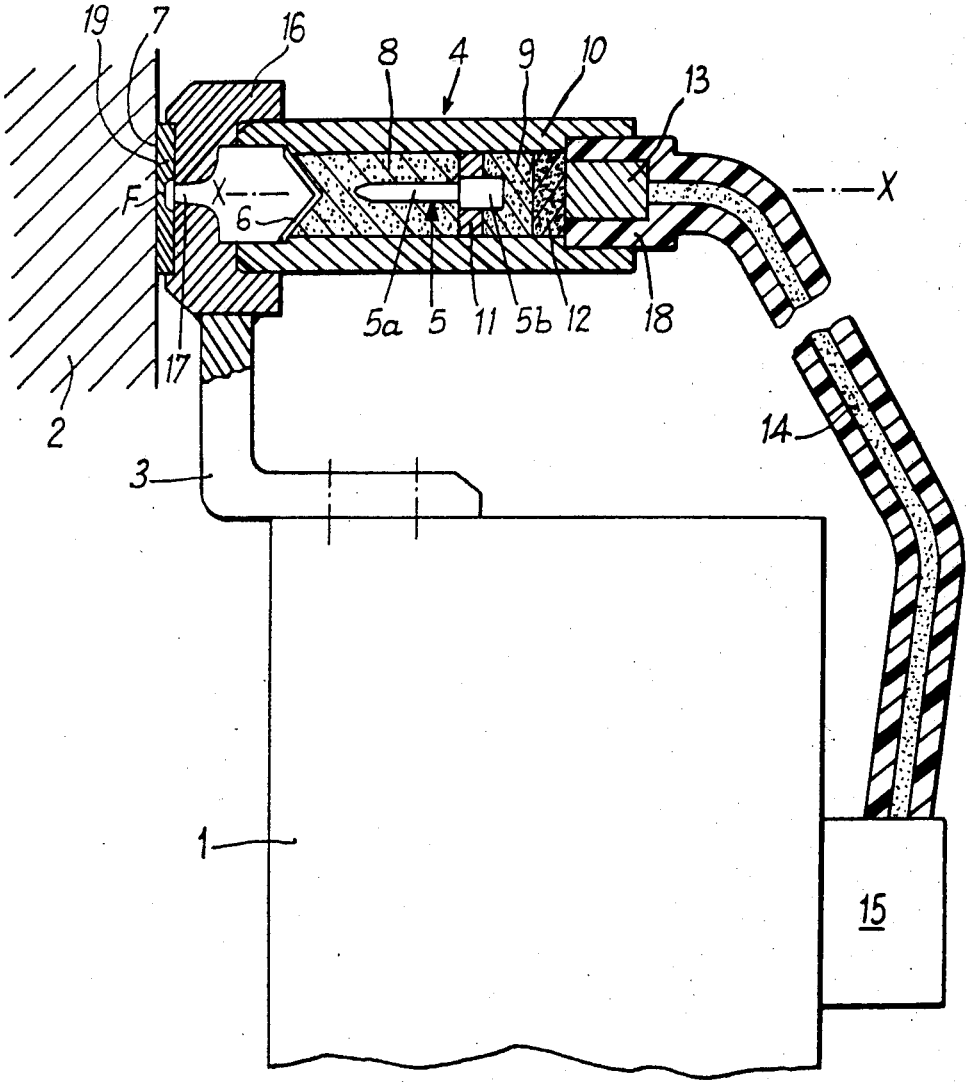

As appears from FIG. 1, the riveting device in accordance with the invention, which is intended to fasten a first element 1 to a second element 2 which is made of hard metal, comprises a support 3 which is common to the element 1 to be fastened and to a hollow charge 4; and a metal rivet or nail 5 which is embedded in the charge of the hollow charge 4, in the axis X—X of the liner 6 of said hollow charge 4, the support 3 having a surface 7 intended to be applied against the hard-metal element 2 and approximately centered on the focal point F of the hollow charge 4.

The liner 6 has a thickness which satisfies the following relationship:

$$3 < M/m < 4$$

in which

M = mass of explosive and m = mass of liner 6.

The apex angle of the liner core has a value of between 40° and 70°, which is the range of existence of a pure hollow charge. The liner 6 is of a material capable of producing the formation of a jet of hollow charge (copper, for instance) and preferably capable of adding a brazing effect to the nailing effect (Cu-Ag alloy, for instance) and of thus perfecting the attachment.

The nail 5 is composed of a shank 5*a* whose diameter is approximately equal to one-quarter of the diameter of the largest conic section of the liner 6 and whose length is approximately equal to six times the diameter of the shank 5*a*. On the side away from the liner 6 the nail 5 has a head 5*b* whose diameter is approximately equal to half that of the diameter of the largest conic section of the liner 6 and whose length is equal to about three-fourths of the diameter of the largest conic section of the liner, these dimensions being given in particular by way of example.

The nail 5 is made of a steel having very good mechanical properties, for instance of type 45 SDC 6h (steel with 0.45% C containing a defined percentage of Si, Mo and Cr). For a charge 4 whose diameter is between 8 and 10 mm, for instance, the nail 5 is located 2 to 3 mm behind the apex of the liner 6. The steel of the nail 5 has undergone heat treatment (tempering and quenching) assuring it the best possible compromise between hardness and resistance to shock.

The charge of the hollow charge 4 consists of two parts 8 and 9, contained in a body 10 of organic or inorganic material capable of absorbing the shock effects. The first part 8, consisting of a powerful explosive, is made either by pouring or by compression directly on the liner 6 in the body 10 so as to produce the space for the shank 5*a* of the nail 5 being formed either by clearance or by means of a form punch. After the nail 5 has been put in place, the second part 9 of the charge is placed around the head 5*b* of the nail 5, using the same method as for the first part 8. Between its parts 8 and 9, the charge may contain an intermediate layer 11 of a different nature, intended to reinforce the detonation wave in known manner.

The priming of the hollow charge 4 is effected by a secondary explosive priming pellet 12 contained in the body 10 and initiated by the reinforcer 13 of a transmission detonating fuse 14, which in its turn is connected to a central priming system 15 which comprises a priming safety. Although this system 15 has been shown in FIG. 1 as being borne by the element 1 to be fastened, it is separated therefrom when the latter consists of a parasitic element which is to be attached to the bottom of an armored vehicle upon the passage of the latter.

The support 3 is made integral with the element 1 for instance by pinning, and with the body 10 of the hollow charge 4 in a manner which will be described in further detail below. It is made of a steel of very good mechanical properties, for instance of type 25 CD 4.5 (steel with 0.25% C, containing a defined percentage of Cr and Mo).

The support 3 is fastened, preferably by welding, to a metal ring 16 provided with a central hole 17. This hole 17, the axis of which is aligned with the axis X—X of the hollow charge 4, has a diameter slightly greater than the diameter of the shank 5*a* of the nail 5 and in any event less than the diameter of the head 5*b* of said nail. On the side facing the liner 6, this hole 17 flares out to leave sufficient free space for the hollow charge 4.

The ring 16 is tightly secured to one of the axial ends of the body 10, whose other end is hermetically closed by the plug-forming end 18 of the fuse 14. A part 19, containing the aforementioned surface 7, is fastened to the ring 16 to complete the closing of the device at the front. In the event that the device is projected onto the element 2 upon the passage of the latter, the part 19 is made of a shock-absorbing material (for instance annealed copper) so as to serve as dampener, preventing the device from rebounding upon its operation.

Figure 2:
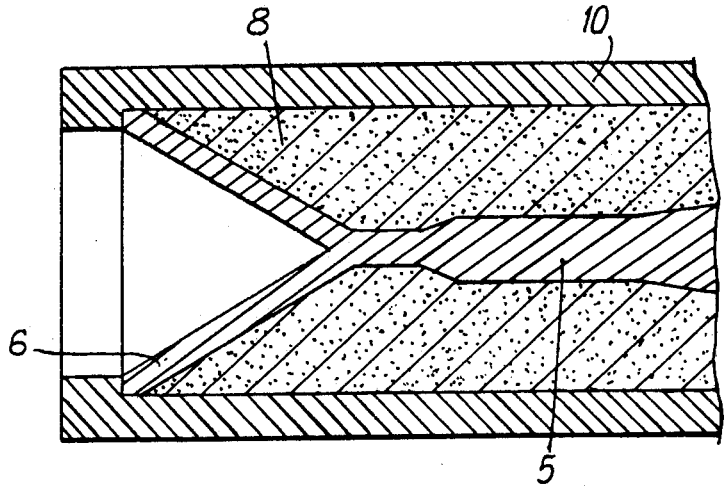
FIGS. 2 and 3 show on a larger scale, in axial section, the front portions of two hollow charges developed in accordance with variants of the hollow charge of FIG. 1.
Figure 3:
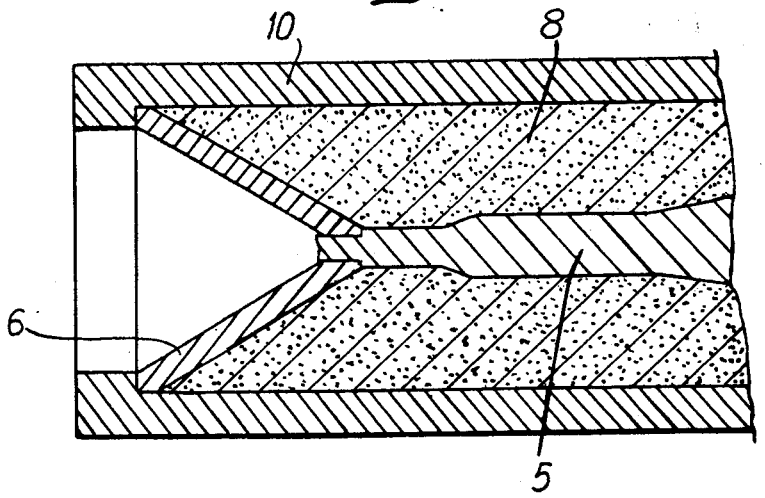

In accordance with the embodiment shown in FIG. 1, the nail 5 is spaced from the liner 6. In accordance with the variants shown in FIGS. 2 and 3 it is nevertheless possible for the nail 5 to be attached directly to the liner 6. In particular, the liner 6 may be integral with the nail 5 (FIG. 2), this part being then for instance possibly of copper, copper alloy, or steel. The nail 5 and the liner 6 may also be made of two different parts (of different or identical material), assembled for instance by riveting (FIG. 3).

Figure 6:
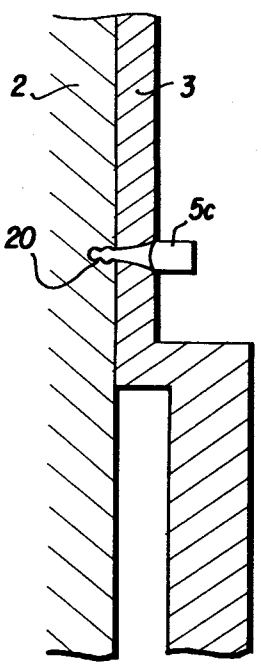
FIGS. 4, 5 and 6 show, in successive diagrams, the operation of the device of FIG. 1.
Figure 5:
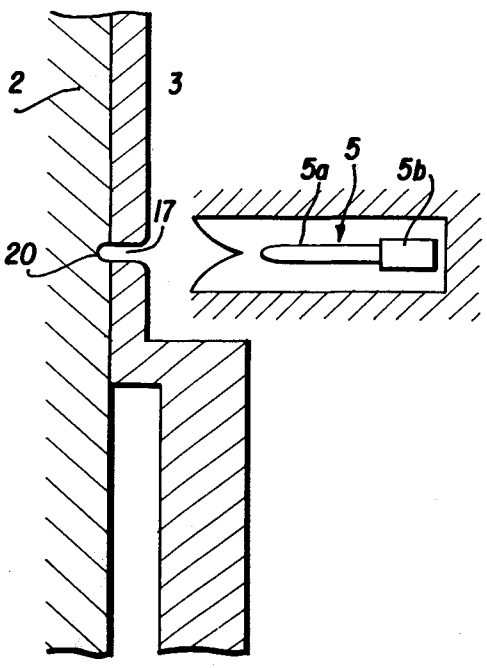
Figure 4:
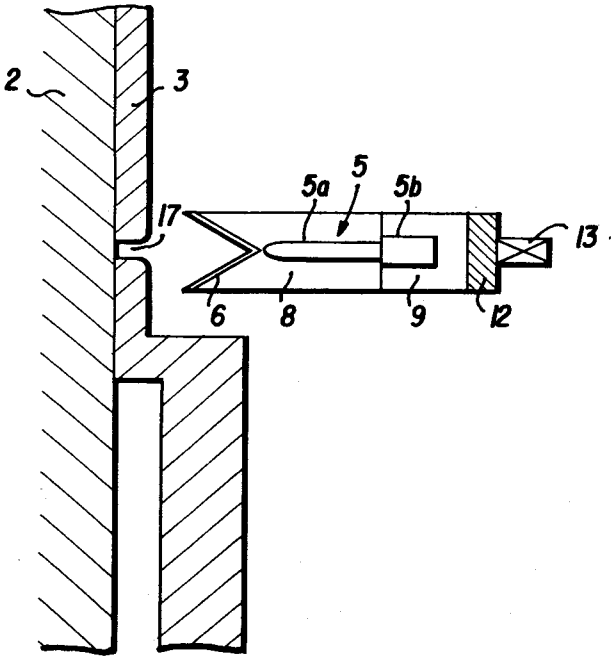

The operation of the device in accordance with the invention is illustrated in the diagrams of FIGS. 4 to 6, in which it has been assumed that the parts 3, 16 and 19 of FIG. 1 are combined in a single part in order to simplify the drawing.

Starting from the priming point (FIG. 4), the detonation wave, being propagated in the charge 8, 9 at a speed on the order of 7500 m/sec, reached the nail 5 which at places in movement at a speed on the order of 300 to 500 m/sec, whereupon it causes the operation as hollow charge which forms a jet (FIG. 5) the velocity of which is greater than 5000 m/sec. Due to the differences in speed between the jet and the nail 5, the effects take place in the following order:

perforating of the part 19 and of the element 2 by the very rapid jet of the hollow charge, through the hole 17 of the support 3, which made the blind hole 20 (FIG. 5), possibly provided with a residual core born of the liner 6.

arrival of the nail 5 which is inserted into the blind hole 20 made by the perforation of the hollow charge and which, after deformation, has been designated by 5*c* in FIG. 6, the head 5*b* of the nail assuring the securing of the support 3 and therefore of the element 1 onto the element 2 of hard metal.

The brazing effect, when present (depending on the nature of the material used for the liner 6), takes place within the blind hole formed by the hollow charge in the element 2 and makes it possible to improve the attachment, the nail 5 being firmly brazed to the inside of this hole.

We claim:

1. A pyrotechnic riveting device for fastening metallic elements together comprising:

a support attached to a first element to be fastened;

a ring element connected to said support element, said ring element having a central bore, said bore having an inwardly flared portion, the outward portion of said bore located adjacent a second element to be fastened;

a hollow body member having one end sealed with the flared portion of said bore, and a second end, said hollow body having a central axis coincident with said bore axis;

a fuse member sealing said second end;

an explosive charge located within said hollow body communicating with said fuse member;

a sealing member for separating said explosive charge from said bore; and a nail member located within said charge and aligned along said axis, said nail member having a shank portion having a diameter smaller than the diameter of said bore and a head portion having a diameter larger than said bore diameter, said nail member being propelled into said bore upon ignition of said explosive charge, said nail member penetrating said second element whereby said elements are fastened together.

2. Riveting device intended to fasten a first element to a second element made of hard metal, comprising a support which is common to the first element and to a body containing a hollow charge made of an explosive loading and a liner adjoining said loading, said liner having an axis, and said hollow charge generates a jet when said hollow charge explodes, and a metallic nail or rivet which is embedded in the explosive loading of the hollow charge and disposed on the axis of the liner, the support capable of being applied against the second element and being approximately centered on an impact point of the jet of the hollow charge.

3. A device according to claim 2, wherein the liner of the hollow charge is made of a material capable of assuring the brazing of the nail within the hole pierced in the element of hard metal by the hollow charge.

4. A device according to claims 2 or 3, wherein the nail is directly attached to the liner of the hollow charge.

5. A device according to claim 4, where the nail is integral with the liner.

* * * * *